US006341877B1

(12) United States Patent
Chong

(10) Patent No.: US 6,341,877 B1
(45) Date of Patent: Jan. 29, 2002

(54) BOLLARD LIGHT

(75) Inventor: Kwan Yew Chong, Kuala Lumpur (MY)

(73) Assignee: Advance Industries SDN BHD, Puchong (MY)

( * ) Notice: Subject to any disclaimer, the term of this patent is extended or adjusted under 35 U.S.C. 154(b) by 0 days.

(21) Appl. No.: 09/593,540

(22) Filed: Jun. 14, 2000

(30) Foreign Application Priority Data

Apr. 5, 2000 (MY) ..... PI 2000 1416

(51) Int. Cl.[7] ..... F21V 11/02; F21V 17/00
(52) U.S. Cl. ..... 362/291; 362/332; 362/354
(58) Field of Search ..... 362/290–293, 362/325, 332, 342, 354, 355, 431, 153.1

(56) References Cited

U.S. PATENT DOCUMENTS 2,147,008 A * 2/1939 Blumenthal ..... 362/291
3,833,804 A * 9/1974 Vesely ..... 362/291
5,075,833 A * 12/1991 Dormand ..... 362/431
5,251,118 A * 10/1993 Budnovitch et al. ..... 362/362

* cited by examiner

*Primary Examiner*—Alan Cariaso
(74) *Attorney, Agent, or Firm*—Jacobson Holman, PLLC

(57) ABSTRACT

A bollard light with enhanced function of diffusing lamp light with a special light colour effect. A transparent coloured diffuser rim is retrofitted onto a clear diffuser lens. The transparent coloured diffuser rim serves to diffuse lamp light with a special light colour effect, while the clear diffuser lens serves to distribute natural lamp light. The concept using a modular louvre unit in conjunction with an intermediate diffuser lens allows for multi-tier louvre configuration. The retrofitting design of a coloured diffuser rim allows for interchangeability and multi-colour choice of coloured diffuser rims. The flexible shape concept of the bollard head allows for choice of various shapes, which can be complemented by similar shapes of bollard body and canopy which can also be of hemispherical, pyramid, flat-top or angular design.

5 Claims, 1 Drawing Sheet

BOLLARD LIGHT

TECHNICAL FIELD

The present invention relates to a bollard light with enhanced function of diffusing lamp light with special light colour effect, which is achieved without any interference to its normal function of distributing natural lamp light to its immediate surroundings.

BACKGROUND ART

Bollard lights popularly being used in the gardens are largely of the types, incorporating a cylindrical, hemispherical or box diffuser of glass or plastics; multi-tier louvres or a combination of both. The normal function of bollard lights is for the lighting up of plants and landscape and as such, the preferred diffused light choice is natural lamp light. However, natural lamp light is monochromatic in character and therefore is not amendable to the play of light colour choice for added attractiveness or special light colour effect.

The use of transparent coloured diffusers or reflectors has been attempted to achieve light colour effects. Unfortunately, this means is unsatisfactory, as they either limit the design flexibility or interfere with the normal function of the bollard light. Use of paintwork on diffusers or reflectors has also been found to be impractical because of failure from poor weatherability.

DISCLOSURE OF INVENTION

The present invention aims to enhance the normal function of the bollard light with enhanced function of diffusing lamp light to emit a special light colour effect, without interfering with the normal function of the bollard of distributing natural lamp light to its immediate surroundings.

The invention resides broadly in the employment of a transparent coloured diffuser rim of glass or plastics, which is welded or retrofitted around the edge of a clear diffuser lens of glass or plastics. The transparent coloured diffuser rim allows lamp light to diffuse through it to emit a special light colour effect while the clear diffuser lens allows natural lamp light to diffuse through uninterrupted to light up its immediate surroundings.

The concept of retrofitting a coloured diffuser rim onto a clear diffuser lens, allows for interchangeability and multi choice of coloured diffuser rims, while the design concept of using a modular system of louvre used in conjunction with an intermediate diffuser lens allows for multi-tier louvre configuration.

At the same time, the invention utilises a flexible shape concept for its bollard head, which can be round, square, rectangular, triangular or polygonal, all of which can be complemented by similar shapes of bollard body and canopy, which can also be of semi-hemispheral, pyramid, flat-top or angular design.

BRIEF DESCRIPTION OF THE DRAWINGS

In order that the invention may be more readily understood and put into practical effect, a preferred example of the invention will now be described with reference to the accompanying drawings, in which.

DETAILED DESCRIPTION OF DRAWINGS

Figure 1:
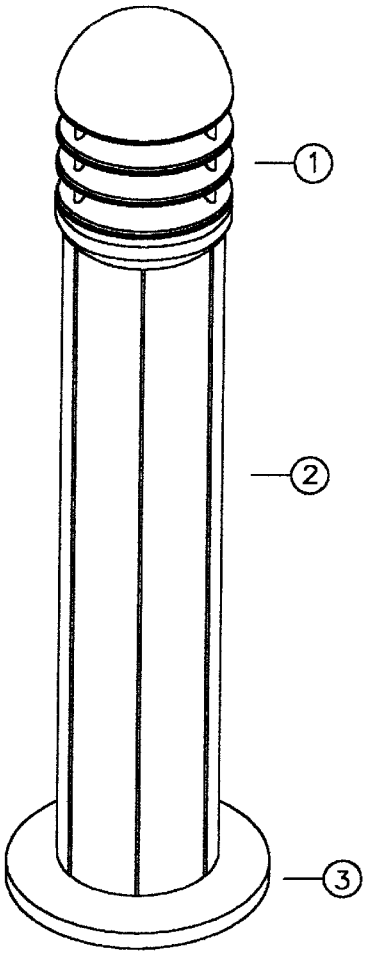
FIG. 1 illustrates a preferred example of bollard light constructed in accordance with the invention.

FIG. 1 illustrates a preferred example of a bollard light comprising a bollard head (1), bollard body (2) and body base (3). The bollard head (1) essentially houses the gist of the invention and the functional component parts of a bollard light, while the bollard body (2) & body base (3) of aluminium or steel serve as a structural support base for the bollard head. The bollard body and body base are powder-coated with plastics to colour choice and for protection against weathering.

Figure 2:
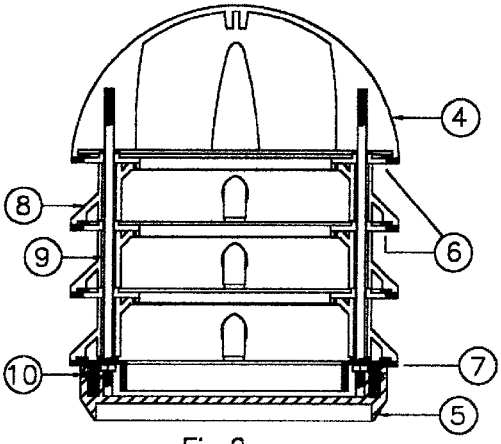
FIG. 2 illustrates an example of a 3-tier louvre bollard head (1) of FIG. 1.

FIG. 2 illustrates an example of a 3-tier louvre bollard head (1) of FIG. 1. Essentially the bollard head comprises a die-cast canopy (4) & mounting base (5) of aluminium or iron; top (6), intermediate (6) & bottom (7) transparent diffuser lenses of glass or plastics; and die-cast or moulded louvres (8) of aluminium or plastics. The whole bollard head assembly of component members (4-8) are stacked and aligned by means of the bolting rods of aluminium or steel (9) and in the order as illustrated in FIG. 2, viz. canopy (4) with anchored bolting rods (9), through which are stacked and aligned the top diffuser lens (6), modular louvre unit (8) with intermediate diffuser lens (6), bottom diffuser lens (7) and mounting base (5). The whole assembly is securely held together by tightening the bolting rods (9) with nuts applied at the bottom of the mounting base (5). The bollard head assembly can be locked to the bollard body or other mounting bases by means of special locking Allen screws (10).

The die-cast canopy (4) is powder-coated with plastics to colour choice and for protection against weathering and can be of semi-hemispherical, pyramid, flat-top or angular design and serves as a decorative head member of the bollard head, as well as for anchoring of the bollard head assembly, when used in conjunction with the diecast mounting base (5) and the bolting rods (9).

Figure 3:
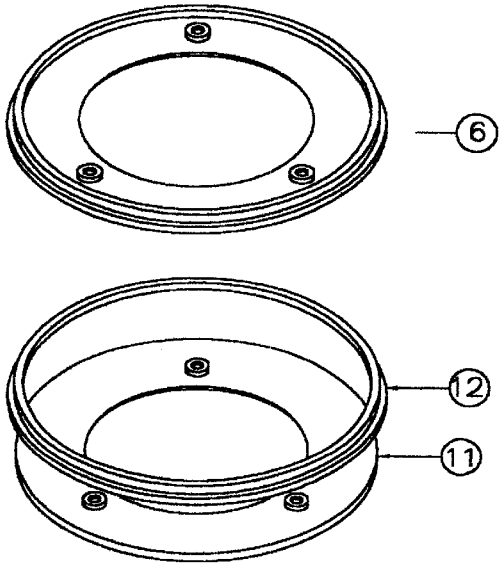
FIG. 3 illustrates an example of a top & intermediate diffuser lenses (6) of FIG; 2.

FIG. 3 illustrates an example of a top & intermediate diffuser lenses (6) of FIG. 2. Essentially the top & intermediate diffuser lenses (6), comprising a clear diffuser lens (11) of glass or plastics, around edge of which is welded or retrofitted a transparent coloured diffuser rim (12) of glass or plastics. The clear diffuser lens serves to diffuse natural lamp light without any interference from the coloured diffuser rim, while the transparent coloured diffuser rim serves to diffuse lamp light to emit a special light colour effect.

Figure 4:
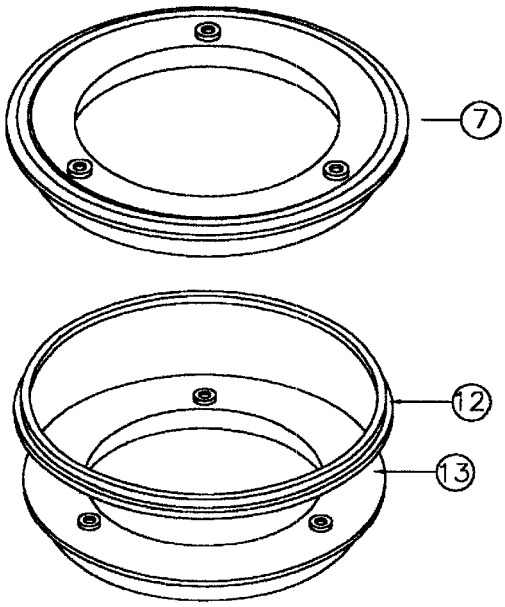
FIG. 4 illustrates an example of a bottom diffuser lens (7) of FIG. 2.

FIG. 4 illustrates an example of a bottom diffuser lens of FIG. 2. Essentially the bottom diffuser lens (7) is similar in design and function to the top & intermediate diffusers (6), comprising a clear diffuser lens (13) of glass or plastics, around edge of which is welded or retrofitted a transparent coloured diffuser rim (12) of glass or plastics.

What is claimed is:

1. A bollard light having a bollard head for enhancing diffusion of lamp light with a special colour effect without affecting distribution of natural lamp light, said bollard head comprising a mounting base;

a modular louvre unit mounted on said mounting base;

a plurality of diffuser lenses on which are mounted said modular louvre units; and a canopy affixed to a top side of said modular louvre unit;

each of said plurality of diffuser lenses being provided with a diffuser rim, said diffuser rim being welded onto an edge of said plurality of diffuser lenses.

2. The bollard light as claimed in claim 1, wherein said diffuser rim is coloured.

3. A bollard light having a bollard head for enhancing diffusion of lamp light with a special colour effect without affecting distribution of natural lamp light, said bollard head comprising a mounting base;

a modular louvre unit mounted on said mounting base;

a plurality of diffuser lenses on which are mounted said modular louvre units; and a canopy affixed to a top side of said modular louvre unit;

each of said plurality diffuser lenses being provided with a diffuser rim, said diffuser rim being retrofitted onto an edge of said plurality of diffuser lenses.

4. The bollard light as claimed in claim 3, wherein said diffuser rim is coloured.

5. The bollard light as claimed in claim 3, wherein said diffuser rim is interchangeable.

* * * * *